US011629471B2

(12) United States Patent
Marshall

(10) Patent No.: US 11,629,471 B2
(45) **Date of Patent: *Apr. 18, 2023**

(54) WATER-BORNE DEBRIS COLLECTION SYSTEM AND METHODS OF USING THE SAME

(71) Applicant: Patrick Marshall, Tehachapi, CA (US)

(72) Inventor: Patrick Marshall, Tehachapi, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/826,164

(22) Filed: May 27, 2022

(65) Prior Publication Data

US 2023/0065821 A1 Mar. 2, 2023

Related U.S. Application Data

(63) Continuation of application No. 17/464,581, filed on Sep. 1, 2021.

(51) Int. Cl.

| | |
|---|---|
| ***E02B 15/04*** | (2006.01) |
| ***B63B 35/32*** | (2006.01) |
| ***E02B 15/10*** | (2006.01) |

(52) U.S. Cl.

CPC ..... *E02B 15/047* (2013.01); *B63B 35/32* (2013.01); *E02B 15/048* (2013.01); *E02B 15/104* (2013.01)

(58) Field of Classification Search

CPC ..... E02B 15/04; E02B 15/046; E02B 15/047; E02B 15/048; E02B 15/104; E02B 15/106; B63B 35/32

(Continued)

(56) References Cited

U.S. PATENT DOCUMENTS 3,612,280 A * 10/1971 Fitzgerald ..... E02B 15/048 210/242.3
3,700,108 A * 10/1972 Richards ..... E02B 15/104 210/242.3

(Continued)

FOREIGN PATENT DOCUMENTS

CN 102020004 B 4/2011
CN 204056238 U 12/2014

OTHER PUBLICATIONS

"Pyrolysis of plastic waste: Opportunities and challenges" article from "Journal of Analytical and Applied Pyrolysis vol. 152 (Nov. 2020) 104804" retrieved form "https://www.sciencedirect.com/science/article/abs/pii/S0165237019308241?via%3Dihub" May 18, 2021.

(Continued)

*Primary Examiner* — Christopher Upton
(74) *Attorney, Agent, or Firm* — Sierra IP Law, PC; William K. Nelson

(57) ABSTRACT

A novel water-borne debris collection system integrated into a waterborne vessel for collecting surface and near surface debris in a body of water, such as a river, lake, or ocean. The apparatus may include a solid collection boom that projects laterally from a vessel and is partially submerged to act as a collection mechanism. The boom also facilitates the propulsion of the vessel by providing a barrier across which a differential water surface level may be created to drive the vessel forward. The apparatus may include a pumping system that draws water from the anterior side of the screen and for multiple purposes, including processing the collected water to remove plastics and other pollutant and debris material therefrom, and to transfer the water to the posterior side of the screen to create the differential water level for driving the vessel forward.

20 Claims, 8 Drawing Sheets

(58) Field of Classification Search
USPC ... 210/170.05, 170.09, 170.11, 242.1, 242.3, 210/747.6, 776, 923
See application file for complete search history.

(56) References Cited

U.S. PATENT DOCUMENTS 4,209,400 A * 6/1980 Mayes ..... E02B 15/047 210/776
4,690,093 A * 9/1987 Lundin ..... E02B 15/046 210/242.3
5,217,611 A * 6/1993 Ayroldi ..... E02B 15/047 210/242.1
7,485,235 B2 * 2/2009 Kellett ..... B63B 35/32 210/776
11,001,352 B1 * 5/2021 Nassim ..... E02B 15/104
2006/0065586 A1 * 3/2006 Walczyk ..... E02B 15/048 210/242.1
2011/0318109 A1 * 12/2011 Miller ..... E02B 15/047 405/68
2020/0208368 A1 * 7/2020 Milanovich ..... E02B 15/104
2021/0404133 A1 * 12/2021 Slat ..... E02B 15/04
2022/0055720 A1 * 2/2022 Dakhil ..... B63B 35/32

OTHER PUBLICATIONS

Machine Translated English abstract of Chinese patent application CN102020004B retrieved from "https://translationportal.epo.org/emtp/translate/?ACTION=abstract-retrieval&COUNTRY=CN&ENGINE=google&FORMAT=docdb&KIND=B&LOCALE=en_EP&NUMBER=102020004&SRCLANG=zh&TRGLANG=en" Sep. 1, 2021.
English abstract of Chinese patent application CN204056238U retrieved from "https://worldwide.espacenet.com/patent/search/family/052197801/publication/CN204056238U?q=pn%3DCN204056238U" Sep. 1, 2021.

* cited by examiner

WATER-BORNE DEBRIS COLLECTION SYSTEM AND METHODS OF USING THE SAME

FIELD OF THE INVENTION

The present invention relates generally to an apparatus for collecting debris from bodies of water and methods of making and using the same. More particularly, the present invention relates to debris collection system integrated into a vessel that is operable to collect large volumes of both fine and coarse debris from large bodies of water and methods of using the same.

BACKGROUND OF THE INVENTION

Ocean pollution is a critical environment issue with few viable solutions to date. The impact of debris such as fine microplastics is widespread and significant, as such material is ingested by small invertebrates and fish, and then makes is way through the food chain. The microplastic pollution, as well as other forms of debris accumulate in large island-like clumps in the calmer surface waters of the ocean, as they are pushed by currents that run along the coast until they come to rest in the central surface areas of ocean gyres. This dynamic is in some ways helpful because the kinds of pollution that accumulate on the surface of the ocean are concentrated in specific, identifiable areas. The natural concentration of the plastics and other debris allows for targeted collection efforts to remove this debris. However, effective marine debris collection efforts have been thus far elusive. Collection techniques using nets and collection screens have been attempted, but are inefficient and improved solutions are needed.

SUMMARY OF THE INVENTION

The present invention provides a novel water-borne debris collection system integrated into a waterborne vessel. The invention described herein an improved apparatus and system for collecting surface and near surface debris in a body of water, such as a river, lake or ocean. The apparatus may include one or more collection boom that project laterally from a vessel and is partially submerged to act as a collection mechanism. The surfaces of the collection booms may be a substantially watertight surface such that they facilitate the propulsion of the vessel by providing a barrier across which a differential water surface level may be created to drive the vessel forward. The apparatus may include a pumping system that draws water from the anterior side of the screen and for multiple purposes, including processing the collected water to remove plastics and other pollutant and debris material therefrom, and to transfer the water to the posterior side of the collection booms to create the differential water level for driving the vessel forward. The net increase in water level at the posterior side of the collection booms creates a force applied to the posterior side of the collection booms resulting from gravity that drives the vessel in a forward direction. The collection booms may be positioned and shaped such that they collect plastic debris and other pollutants at or near the surface of water within their lengths and funnel the debris and pollutants toward a central aspect of the collection booms whether the inlet for the pumping system is located. The debris and pollutant-laden surface water may be passed through a filtration system to remove the particulates from the water and the collected debris may be processed by pyrolysis and/or other processes. The apparatus may additionally include one or more collection belts or conveyors partially submerged at or near the central aspect of the vessel for collecting large debris from the water for mechanical processing to reduce the size of the debris, such as grinding process. The mechanically-processed, smaller particles may be transferred to the processing (e.g., pyrolysis) system used to process smaller debris and pollutants. The cleaned water may then be passed through conduit to release behind the screen to create propulsion for the vessel. The present invention provides an improved and practicable system for collecting debris and pollutants from bodies of water.

The present invention incorporates the collection booms into a vessel that can deployed rather than a separate collection mechanism that is transported to a clean location and then deployed as a standalone structure. The incorporation of the collection screen into a vessel provides many advantages over other systems, including ease in deployment and mechanical control of the collection booms and other collection devices, controllable propulsion mechanisms to drive the collection booms through the water at a pre-determined pace, and the ability to include debris and pollutant processing systems in the vessel. The inclusion in a steerable vessel allows for setting and changing the course of the collection booms in a deliberate manner, enabling operators of the vessel to react to the dynamics of the debris flows (e.g., in response to ocean currents) and direct the collection screen at areas in the water with the highest concentrations of debris. The debris processing may be constant with the water collected by the pumping system being passed continuously through the filtration system and the debris processing system. Thus, the vessel itself is a debris processing and recycling facility, avoiding the complicating issue of transporting collected debris to a processing facility, which hampers conventional debris collection solutions. The present valve system offers considerable versatility as well, as it may be scaled in size or reconfigured to accommodate bodies of water of different sizes (e.g., rivers, lakes, oceans, etc.) by reducing the dimensions of the overall system.

The debris collection is performed by deployable bilateral booms operable to collect objects floating on or suspended near a surface of water. The booms include deployable portside and starboard booms that may be extended from a waterborne vessel in a body of water (e.g., a lake, river, or ocean). The booms may be symmetrically arranged in the deployed position, extending from the port and starboard sides of the vessel and may be connected to a central screen near the stern of the vessel, such that the collection booms and the central screen collectively form a continuous collection surface. The collecting system is operable to move along the surface of the water with the booms partially submerged and operable to collect debris and floating material from the surface of the body of water and material floating near the surface. The booms may extend from the vessel, and when deployed may have a curvature with a forward concave face and/or may be obliquely angled toward the front of the vessel such that material collected by the booms is funneled toward the rear of the vessel. In some embodiments, the booms may be constructed to have buoyancy to reduce stress on the connection between the booms and the ship. For example, each boom may have a watertight surface and enlarged inferior submerged aspect that displaces sufficient water to provide buoyancy to each boom. In other embodiments, each collection boom may have one or more buoys (e.g., metallic buoys) having a conical, circular, or cylindrical geometry to provide at the upper portion of the boom at the waterline, which may provide buoyancy to the boom and reduce stress on the vessel.

The debris collection system may include several electrical and electromechanical elements that are monitored and/or controlled by a central electronic controller. The controller may include a host computer or programmable logic controller (PLC). The host computer or PLC allows the use of a high-level programming language to generate control commands that are passed to the controller. Software running on the host computer is thus designed to simplify the task of programming the controller and controlling the electrical and electromechanical devices of the debris collection system and other processing systems that the controller manages and controls. The controller may be operable to collect data from various devices in the debris collection system and other systems on the vessel to monitor the operation of the various devices and to control the operation of such devices. The controller may be in electrical communication with one or more graphical user interfaces, spool mechanism motors, conveyors, sensors, pyrolysis system, cable tension measurement system, various parameters from the vessel, and other devices in the vessel and debris collection system.

The booms may be deployed by a deployment assembly that includes a tether and traveler system positioned between bow of the vessel and an aft extension frame extending from the stern of the vessel to provide an anchoring point for the cable and traveler system. The tether and traveler system may include one or more forward spool mechanisms at or near each side of the bow of the vessel and one or more aft spool mechanisms at each side of the aft extension frame, providing one or more portside pairs of forward and aft spool mechanisms and one or more starboard pairs of forward and aft spool mechanisms. Each paired set of spool mechanisms may include one or more tethers (e.g., chains, cables, ropes, etc.) running between the forward and aft spool mechanisms and tethers may be routed through boom spool mechanisms or fixedly connected to an anchor or other structures operable to engage with the tethers at or near the distal ends of each boom. The booms may be deployed by the rotation of the of the paired forward and aft spool mechanisms such that the one or more tethers are pulled toward to the aft spools, thereby pulling the boom spools, anchors, or other structures toward the aft spools and in turn pulling the booms toward the rear of the vessel. The booms may pivot on a large pivoting joint positioned at or near the stern of the vessel to allow the booms to pivot outward away from the hull of the vessel and deploy laterally. The boom spools, anchors, or other receiving structures positioned on or within the booms may be connected to the one or more tethers running between forward and aft spool mechanisms, such that as the tethers are pulled toward the aft spool mechanisms and the booms are thereby moved toward the aft spool mechanisms. For example, the collection booms may have spools that are stationary and unable to rotate, such that tension applied to the tether by the rotation of the aft spool mechanism pulls the boom spool toward the aft spool and applies sufficient tension to pivot and deploy the boom. As the boom is deployed the forward spool may rotate to let the one or more tethers out to prevent the application of tension to the one or more tethers that opposes the tension applied by the aft spool mechanisms. The opposite stowing operation may be applied to draw the booms inward toward the hull of the vessel.

The collection booms may be connected to an extended frame structure (a truss system) that extends posteriorly from the stern of the vessel, and may be in alignment with the vessel. The extended frame may include a rigid metal frame structure, such as metal beams or pipes that extend horizontally or substantially horizontally from the stern of the vessel to a pre-determined posterior distance from the stern of the vessel. The extended frame may include a first portion positioned between the stern of the vessel and the central screen and the pivoting points of the collection booms, and a second portion that extends beyond the central screen. The aft spooling mechanisms may be positioned at or near the posterior end of the second portion of the extended frame structure. The first and/or second portion of the extended frame structure may have a flotation mechanism to aid in supporting the weight of the extended frame. For example, the first and second portions may include pontoons and/or other flotation structures. The central screen may be mechanically connected to the first portion of extended frame structure, providing an anchor point to the vessel for the collection booms. The collection booms may be connected to the central screen by pivoting joints that allows the tethers and forward and aft spooling mechanisms to pivot the collection booms between stowed and deployed positions.

In some embodiments, when the collection booms are deployed to the open position may include unlocking a transmission system in the forward spool mechanism (unlocking a tether reel), and the collection booms may be released from the hull of the vessel, and the force of the fluid acting on the forward surfaces of the collection booms may assist in deploying the collection booms to the open position. The one or more aft spool mechanisms and a motor driving the aft spool mechanisms may be in electrical communication with a tension sensor (e.g., strain gage) that is operable to communicate the cable tension to the controller to allow the controller to adjust the activation of the motors driving the forward and aft spool mechanisms to maintain tension on the tether at a pre-determined, optimized value. The controller may also be operable to monitor the condition of the forward and aft spools to determine when the collections booms are fully deployed and fully stowed. For example, the spooling mechanisms and/or the motors mechanically connected thereto may include an encoder (e.g., a rotary encoder) in electronic communication with the controller that allows the controller to monitor the advancement and position of the collection booms as the forward and aft spooling mechanisms rotate and move the collection booms into position. Additional sensors may also assist the controller in determining the position of the collection booms and when to activate, adjust, or arrest the motor activity, such as optical sensors that monitor collection boom position. An accelerometer in electronic communication with the controller may be placed at a position at or near the upper surface of the boom to communicate data to the controller. The accelerometer data may allow the controller to control both the forward and aft motors to release or hold a specific amount of cable line such that the boom does not translate abrupt or jerky motion to the vessel. The boom surface may be retracted to the closed position by the frame winch reeling in the boom cable, and the aft and forward cable systems may reel or unreel the line based on accelerometer data and controller calculations. Once the aft spool has reached the ideal position, the cable transmission (e.g., hook and pawl lock) may be locked in position to maintain optimal tension on the cable without loading from the actuator.

In some embodiments, when the collection booms are retracted to the stowed position, the transmission mechanism of the aft spooling mechanisms may be unlocked, and the transmission mechanism of the forward spooling mechanisms may be engaged to allow the motors to spin the axles, and the tethers may be reeled in. Thus, the tension in the aft tethers may be reduced and the tension in the forward tethers may be increased to pull the collection booms into the stowed position. Once the collection booms have reached the final position, the tension on the aft tethers may be fixed in place by the transmission system and the forward spool is locked in place, with a hook and pawl or braking system, for securing the collection boom in place. Forward tethers on both the starboard and port sides may be routed through a port system that may have a pulley system for directing the cable to the tether anchors on the collection booms. The pulley system may prevent fray and surface fatigue on the tethers. In some embodiments, a damper (e.g., a shock or spring system) may be positioned between the extension frame and the collection booms. The damper may be operable to prevent loading on the collection boom and prevent loading on the vessel.

In another embodiment, a boom may be comprised of a plurality of boom sections having a hinged connection on the circumferential ends of the arc path of the boom section. The hinged connections may be offset to a posterior end (outside) and an inner end (surface collecting and directing plastic) in an alternating fashion to allow the collection surface to collectively extend together and form a uniform surface. The opposing ends of the hinged connections may have lip and groove mating surfaces to facilitate joining the ends of each section of the boom together. Atop each of the boom sections may be a rotatable shaft that receives a boom cable. The frame may have a winch operable to deploy and retract the boom cable. In such embodiments, the closed position may configure the plurality of boom sections into a stack or a scissor linkage configuration. Deployment of the boom from the closed position includes the steps of releasing the boom winching system from the locked position and allow the force of the water on the screen to facilitate moving the various sections to an open position as the boom sections are extended to the open position both the aft and forward cable systems are extended to allow the boom to join together. An additional watercraft may be used to assist in the deployment of the boom sections to form the collection booms, such as a tugboat or other motor-driven watercraft. A tow line may be attached to the distal boom section of each collection boom and the additional watercraft may pull the distal boom section in a lateral or substantially lateral direction away from the hull of the vessel to assist in deployment.

The forward and aft spools may be actuated by a motor in mechanical communication with a rotatable structure (e.g., an axel, sprocket, etc.) connected to or integrally formed in the spooling mechanism. The motor may be connected to the rotatable structure by a gearing assembly, chain, direct axle connection, or other mechanical connection such that the rotation of the motor drive shaft translates to the rotatable structure of a spool. Each aft spool mechanism and forward spool mechanism may have its own motor or may be coupled by a transmission structure (e.g., gears, drive chains, etc.) to a shared motor. The motor may be an internal combustion engine (e.g., a diesel engine, a gasoline engine, etc.), or an electric motor (e.g., a DC megawatt class motor, or other appropriate motor). The one or more motors that are mechanically connected to the forward and aft spools may be controlled by the controller or by an additional deployment assembly controller (e.g., a computer having a microprocessor) in electronic communication with the one or more motors. The controller may have software operable to be used as machine executable instructions stored in a memory of said controller that allow the controller to coordinate the activation and operation of the one or more motors, such that the collection booms may be effectively deployed and stowed.

The collection booms may also be utilized to turn the vessel by independent retracting or deploying the collection booms, e.g., to create differential drag on each side of the vessel. The controller may be operable to activate and operate the motors connected to the forward and aft spools on each side of the vessel. For example, the controller may activate the one or more motors connected to the forward spool on the starboard side of the vessel to draw the collection boom on the starboard side inward toward the hull. The force applied to the water in contact with the starboard collection boom as the collection boom is being retracted may provide sufficient force to pull the vessel toward the starboard and create a rightward turn. In some examples, the starboard collection boom may be completely retracted with the portside collection boom remaining deployed such that there is greater drag on the portside, causing the vessel to take a leftward turn. The same dynamics apply to the independent retraction of the portside collection boom. It is to be understood that the starboard and portside collection booms may be deployed and retracted independently and incrementally through the controller. This is independent and incremental control of the individual collection booms allows for various arrangements of the collection booms with collection booms in various symmetrical or asymmetrical positions.

The controller may measure the load on the boom and collecting the surface and display the loading measurements to a human operator on a graphical user interface. The controller may measure the torque on the motor using a torque sensor (e.g., a static or dynamic torque sensor) in mechanical communication with said motor, and compare the torque to the tension of the cable sensor, and may adjust the cable motors of the port or starboard motor of either the aft or forward cable systems to provide a load equilibrium on the boom. In some embodiments, the controller may be operable to autonomously determine necessary motor torque adjustments to provide stability and equalization of the tension on each of the tethers whilst maintaining collection boom loading in equilibrium. The controller may also receive data from encoders that monitor the motors mechanically connected to the forward and aft spooling mechanisms that allow the controller to monitor the advancement and position of the collection booms as the forward and aft spooling mechanisms rotate and move the collection booms into position. A central gyroscope may be positioned at the vessel's center mass, and the data may be processed by the controller, and boom tether tension may be adjusted to provide vessel stability in rough water.

The collection booms and vessel may be of substantial size, with the vessel being a tanker ship or of similar size, and the booms having a length substantially equal to the length of the vessel (e.g., about 500 feet to about 1000 feet). In some embodiments, the collection booms may have a length that is equal to a substantial portion of the length of the vessel (e.g., about 200 feet to about 800 feet). The height dimension of the collection booms may be in a range of about 20 feet to about 80 feet, where the majority of the height dimension is submerged to collect materials that are suspended at shallow depths in the water column. Many of the plastic and other debris and contaminants to be collected are found suspended at such shallow depths. The collection booms may also include a continuous face without gaps or perforations, such that fine debris are collected by the boom.

The collection booms may thus be of substantial size and mass, and must therefore be made of strong, robust materials. The collection booms may be comprised of rigid materials having some limited flexibility. The boom material should also be non-corrodible material, as they are deployed in water, including marine water, which corrode most metals and many other materials. The collection booms may comprise materials such as stainless steel, other non-corrodible steel alloys, aluminum alloys, fiberglass and ceramic composites, carbon fiber and ceramic composites, and other materials. In some embodiments, the boom may include an inner rigid structural material such as a steel or other structural metals with a non-corrodible material coated over the outer surface of the structural material. Such non-corrodible coatings may include anti-fouling coatings, anti-corrosion coatings, foul releasing coatings, self-cleaning, self-polishing coating, epoxy resins, coal tar/epoxy resin, chlorinated rubber, isomerized rubber, polyurethane resins, and/or zinc-rich paints. In some embodiments, the collection booms may include a metal framework having a grid structure on which a lighter material such as fiber glass, carbon composite, or other polymeric material may be layered to provide a continuous sheet thereover.

The deployable collection booms may have one or more curvatures. They may include a curvature along their lengths that bows the boom toward the bow of the ship when the booms are deployed, having a concave curvature facing in a forward manner. The lengthwise curvature may have the effect of pushing collected debris and material toward the stern of the ship where it may be collected. The booms may also have a curvature along their faces that results in a concave, forward oriented face that tends to push subsurface material upward toward the surface of the water. For example, the upper portion of the face may have a longer radius of curvature than the lower portion of the face. The material pushed toward the surface of the water may then be pushed toward the stern of the ship by the lengthwise curvature, where it can be collected.

The present invention may include multiple collection mechanisms. A liquid collection mechanism may include one or more pipes that have a submerged or partially submerged open end near the stern of the ship that are operable to draw in water from the area of the stern and particulates and debris up to a pre-determined size limit. In some embodiments, the one or more pipe openings may be fitted with a coarse filter have a perforation size in a range of about 1 $cm^2$ to about 10 $in^2$ (e.g., about 1 $in^2$ to about 4 $in^2$, or any value or range of values therein). The surface water and debris collected by the one or more pipe openings may be drawn in by a fluid pump in fluid communication with the one or more pipes. The water and debris pumped through the one or more pipes may be routed to a separation unit operable to filter and collect the debris and material from the collected water. The debris and material are then transferred to a processing unit to be converted into usable fuel through a pyrolysis process, or other material conversion process. The filtered water may pumped back to the stern area of the boat for use in propulsion of the vessel, which is discussed in more detail below. The one or more pipes may be mounted or form part of the extended frame structure that supports the collection booms and other structures.

Water collected through an intake port may be transported through collection pipes to a filtering system for removing microplastics and other particulates from the collected water. The filtering system may have a series of screen filters of different pore sizes, and the collected water may be passed through the filters in series from the largest pore size filter to the smallest. The filters may have a pore size in a range of about 5 $\mu m^2$ to about 1 $cm^2$. In some embodiments, the water passed through the screen filters may be further filtered by an additional process, such as reverse osmosis, in order to remove additional microplastics and smaller particles, such as nanoplastics. The filtered water may then be collected and passed to the pumping system via a return pipe. The filtering system may include a self-cleaning mechanism for removing any clogging in the filters. For example, the filtering system may include a backwash function.

The debris collection system may also include one or more coarse debris collectors positioned at or near the stern of the vessel to collect large objects and material in the water (e.g., fishing nets, large plastic objects such as bottles, packaging, etc., large pieces of Styrofoam, etc.). The collectors may include one or more partially submerged conveyors operable to collect coarse objects at or near the surface of the water at or near the stern of the vessel. In some embodiments, the conveyors may include protrusions such as claws, teeth, plates, or other protruding structures that aid in collecting coarse materials. The collected large debris and materials may be transferred via a conveying system to a grinding station to be reduced to a size in a predetermined range: a range of about 0.25 $cm^2$ to about 1 $cm^2$. The materials recyclable for fuel ("pyrolyzable materials", e.g., Polypropylene, Polystyrene, Polyvinyl Chloride, Polymethylmethacrylate, etc.) may be segregated from the rest and ground separately from the remaining material. The controller may measure the conveyor output and record the type of recyclable materials collected from the system. The conveyor measurements may be done with a combination of both optical sensors (e.g., 3D-laser scanning) and weight sensors (e.g., pressure sensors) that are compared by the controller to a database of recyclable waste characteristics. For example, the database may include the geometry, weight, size, and surface finish of a material. Materials stored in the database may range from plastic, wood, and composite materials, used in the manufacturing of fluid containers, plastic bins, wood, composite materials (e.g., cardboard boxes), metallic fluid containers. The data from the conveyor measurement systems are communicated to the controller, dividing and sorting the material into various categories. The pyrolyzable materials may then be conveyed to the grinding station.

The grinding station may include one or more industrial grinding apparatus operable to grind a wide range of materials. Grinder types may include granulators, hammermills, shear shredders, using abrasion with compression to pulverize materials, usually to produce granular products. There may be a plurality of grinders to further refine the material into smaller particles for densifying the recyclable materials. The pyrolyzable materials may be collected from the grinder and placed in a bath containing water or a washing solution and agitated in the bath in order to remove residues and unwanted surface contaminants thereon, such as oils, organic particulates or other debris. The pyrolyzable materials may then be removed from the bath and transferred to a densifier that compresses materials and removes water or solution from the bath. A densifier may be an agglomerator or plastic granulator operable to refine the shredded materials into chunks or small granular for easy transportation into a pyrolysis chamber. For example, the the pyrolyzable materials may be reduced to a substantially consistent size in a range of about 1 $cm^2$ to about 3 $cm^2$ (e.g., in a range of about 1.5 $cm^2$ to about 2.5 $cm^2$, or any value or range of values therein). Heat may also be applied in the densifier to evaporate liquids. The materials other than the pyrolyzable materials may be ground separately from the pyrolyzable materials and collected for storage.

The pyrolysis process may be used to produce one or more fuels from a mix of polymeric materials collected by the collection system. The fuel created by the pyrolysis process may vary depending on the composition of the material (e.g., plastics) fed into the recycling process. Some of the high-temperature products of the reaction may be hydrocarbon gases, light oils, synthetic crude oil, crude oil, an oil mixture referred to "pyrolytic liquid oil", carbon (e.g., graphite, carbon black, sludge, etc.), and/or other products. For example, liquid oil products may produced in a range of about 60% to 80% of the mass of the input plastic waste, gas may have a range of about 15% to 25%, and carbon black may have a range of about 5% to 15%.

The pyrolysis process may include several processing steps, including one or more of placement in and sealing in a pressure vessel, application of a partial vacuum and heat to the vessel to boil and separate the materials into different hydrocarbon components, separation of the hydrocarbon components, and transferring the pyrolyzed material into a separation process to recover hydrocarbon fuels. The densified pyrolyzable material may be transferred to a chamber (e.g., pyrolysis chamber) for pyrolysis. The chamber may be sealed to form a pressure vessel. In some embodiments, the distillation may be of the atmospheric type where the pressure vessel is not under vacuum and may be suitable for collecting butane and lighter products. In other embodiments, the pressure vessel may be placed under a vacuum, removing oxygen, nitrogen, and other air components from the pressure vessel, which would serve as contaminants to the pyrolysis process. The temperature in the pressure vessel may be increased to an operation range of about 300° C. to 900° C. The specific temperature of the pressure vessel may be varied depending on the temperature required to melt a particular combination of pyrolyzable materials present in the chamber. The controller may determine the ideal temperature and pressure settings for the combination of recyclable materials collected and prepared for the pyrolysis process. The pyrolysis process may utilize one or more catalysts, such as zeolite minerals (e.g., ZSM-5, zeolite, Y-zeolite, MCM-41 zeolite, and/or other zeolite catalysts), HZSM-5, mesoporous $SiO_2$—$Al_2O_3$, or other catalysts to facilitate the conversion of the waste material to usable hydrocarbon fuels.

The pyrolyzable materials may be boiled in the chamber to form distinct components, which may include oil, gas, and black carbon slag. The reaction may be carried out for a period in a range of about 10 minutes to about 80 minutes, (e.g., about 30 minutes to about 45 minutes, or any value therein), which may be sufficient time to convert the plastic waste (organic polymers) into hydrocarbon monomers under the reaction conditions. Components of the pyrolyzed mixture may be separated for use as fuel. In some embodiments, the pressure vessel may be in communication with a diverging nozzle for siphoning the gases to a condenser (liquification apparatus) through an oil and gas line. The condenser may cool the gases from the pressure vessel and route them to a fractional distillation unit. The fractional distillation unit may then separate the hydrocarbon fractions of the harvested pyrolysis output via conduit to diesel tank, gasoline tanks, butane, propane, and other products. In other embodiments, the gas component mixture in the liquification apparatus may be routed to a station for centrifugation, and the various layers of fluid may be siphoned into containers for further refinement. The liquid portion ("pyrolytic liquid oil") can be used as a fuel without further refinement, and its use may be optimized by mixing with a refined fuel, such as diesel. Such mixtures can be used in a diesel engine. The solid slag (e.g., black carbon) left in the pyrolysis unit expelled from the bottom of the pyrolysis chamber for collection and later offsite processing.

The hydrocarbon gases and liquid generated by the pyrolysis process may be utilized onboard the vessel for fuel needs, including for use in propulsion of the ship, running various systems in the ship (e.g., pumps for moving collected water, heating and cooling systems, boom deployment motors, etc.), and/or in electricity generation to provide electricity for running various systems (e.g., in a propane generator, gas or diesel generator, steam power plant, and/or other electrical generator systems). The use of the hydrocarbon fuels in onboard systems in the vessel allows the vessel to be wholly or partially self-sustaining, thereby allowing the vessel to be deployed for waterborne debris collection for a longer period of time than would otherwise be possible.

The water pumping system of the ship functions in both the collection of the waterborne debris by drawing surface water through the collection pipes at the stern of the ship and in the propulsion of the ship. The water may be drawn through the collection pipes to the pyrolysis system, where one or more filtering mechanisms catch the plastic particulate matter and removes it from the collected water. The particulate matter may be delivered to the pyrolysis chamber and the water may be piped back through a loop to the stern of the ship and to the exterior of the ship through one or more aft pipe extensions that extend beyond the collection booms such that the one or more aft pipe extensions are operable to deliver the water to the aft (posterior) side of the boom. The one or more pipe extensions may have open ends positioned to the aft of the collection booms. The rate of water flow from the stern of the ship to the aft side of the boom is sufficient to create a height differential between the water on the aft side of the collection booms and the forward side of the collections boom to cause the raised water to apply a force to the aft side of the collection boom. The gravity acting on the raised surface level of the water generates a force applied to the aft side of the collection booms that pushes the collection booms in a forward direction and thereby propels the vessel forward. The rate of water flow may be in the range of about 1000 GPM to 1500 GPM (e.g., about 60,000 GPH to 90,000 GPH, or any value therein). The pump may be a high flow rate pump operable to move high volumes of water, such as large centrifugal pump having an impeller with a radius in the range of about 8 inches to about 24 inches operable to spin at a rate in a range of about 1000 rpm to about 4000 rpm, a suction flange having a diameter in a range of about 12 inches to about 24 inches, and a discharge flange having a diameter in a range of about 8 inches to about 15 inches. The motor may be electrical and powered by an onboard generator powered by hydrocarbon gases (e.g., butane, propane, and/or other hydrocarbon gases) and/or liquid fuels (e.g., diesel, gasoline, pyrolytic liquid oil, etc.) generated through the pyrolysis process.

The propulsion created by the water displacement is sufficient on its own to drive the vessel forward during a debris collection operation, and may provide a velocity in a range of about 0.5 knots to about 3.0 knots. This relatively slow pace is adequate and preferred for the collection process as time is needed to funnel debris caught by the lateral areas of the collection booms toward the stern of the ship where they can be collected by the one or more collection pipes or the one or more collection conveyors. During the collection operation, the engine of the vessel (e.g., a diesel engine for driving one or more propellers) can be shut down, and fuel for the engine can be saved. Additionally, the pyrolysis process can produce additional fuel for the engine of the vessel (e.g., diesel or pyrolytic liquid oil) that can be added to the fuel supply for the engine of the vessel. Thus, the vessel may sustain a debris collection operation for periods of time far longer than if the vessel needed to run its engine continuously and/or the vessel was not equipped with a pyrolysis system for generating hydrocarbon fuel from the collected polymeric waterborne debris.

In one aspect, the invention relates to a waterborne debris harvester apparatus for use with an aquatic craft, the aquatic craft including a hull, a bow and a stern, the waterborne debris harvester comprising at least one deployable collection boom for collecting debris from a body of water having a proximal end positioned at a pivoting joint and a distal end that can be positioned proximal to the hull and at an extended collection position away from the hull; a boom deployment system which includes a tether system to which the at least one boom is mechanically connected, a rearward extending frame member, and a connection point at or near the bow of the aquatic craft; and a pumping system operable to collect debris-laden water from an area anterior to the at least one deployable collection boom and to dispose of the collected water on the posterior side of the at least one deployable collection boom, thereby creating a differential water level between the anterior and posterior sides of the deployable collection boom that results in a force applied to the posterior side of the deployable collection screen that propels the aquatic craft forward.

In another aspect, the invention relates to an aquatic vessel comprising at least one deployable collection boom for collecting debris from a body of water having a proximal end positioned at a pivoting joint and a distal end that can be positioned proximal to the hull and at an extended collection position away from the hull; and a boom deployment system which includes a tether system to which the at least one boom is mechanically connected, a rearward extending frame member, and a connection point at or near the bow of the aquatic craft.

In another aspect, the invention relates to a waterborne debris harvester apparatus for use with an aquatic craft, the aquatic craft including a hull, a bow and a stern, the waterborne debris harvester comprising at least one collection boom for collecting debris from a body of water having a proximal end positioned near the stern; and a pumping system operable to collect debris-laden water from an area anterior to the at least one collection boom and to dispose of the collected water on the posterior side of the at least one collection boom, thereby creating a differential water level between the anterior and posterior sides of the collection boom that results in a force applied to the posterior side of the collection screen that propels the aquatic craft forward.

In another aspect, the invention relates to a method of collecting waterborne debris using a harvester apparatus incorporated into an aquatic craft, the aquatic craft including a hull, a bow and a stern, comprising deploying at least one collection boom for collecting debris from a body of water having a proximal end positioned at a pivoting joint and a distal end that can be positioned proximal to the hull and at an extended collection position away from the hull, including pivoting the at least one boom at the pivoting joint using a boom deployment system, the boom deployment system including at least one tether to which the at least one boom is mechanically connected, a rearward extending frame member to which the at least one tether is connected, and a tether connection point at or near the bow of the aquatic craft; and pumping water from a forward side of the at least one boom using a pumping system operable to collect debris-laden water from the forward side and disposing of the collected water on the aft side of the at least one collection boom, thereby creating a differential water level between the forward and aft sides of the at least one collection boom that results in a force applied to the aft side of the at least one collection boom that propels the aquatic craft forward.

Further aspects and embodiments will be apparent to those having skill in the art from the description and disclosure provided herein.

It is an object of the present invention to provide a collection system for waterborne debris that is actively driven and able to actively collect waterborne debris for sustained periods.

It is a further object of the present invention to provide a debris collection system incorporated into an engine-driven vessel and having deployable booms for collecting the debris.

It is a further object of the present invention to provide a collection system for collecting waterborne debris that draws debris-laden water from a contaminated body of water, filters out the debris, including particulates from the collected water and then returns the water.

It is a further object of the present invention to provide a debris collection system incorporated into a vessel having collection booms for collecting the debris and a water collection and return system that collects water from the front of the booms and then deposits the water on the posterior side of the boom to generate propulsion for the vessel.

It is a further object of the present invention to provide a collection system for collecting waterborne debris that includes a debris processing system for converting the debris a usable fuel.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Figure 1:
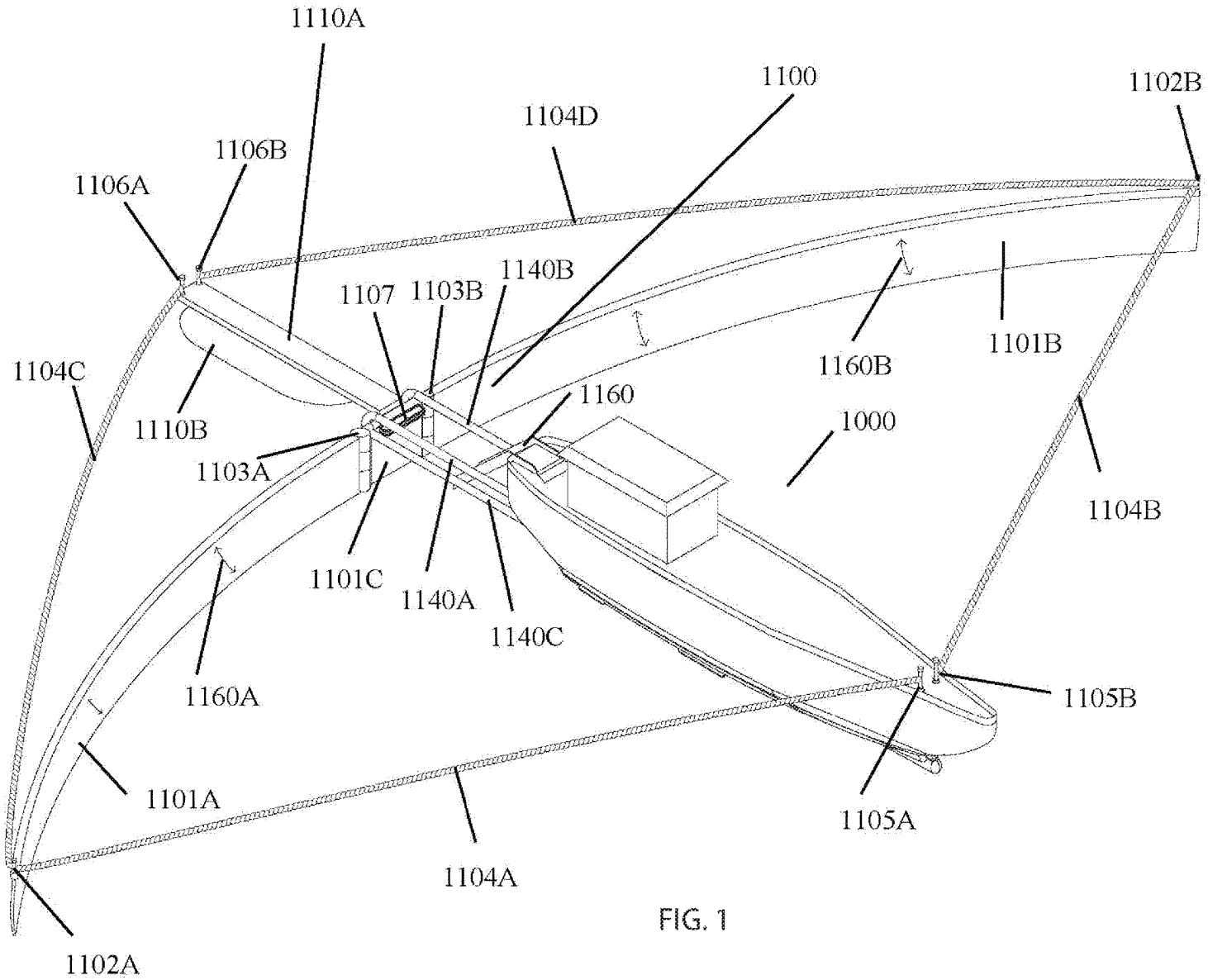
FIG. 1 provides a perspective view of a vessel and debris-collection system, according to an embodiment of the present invention.
Figure 2:
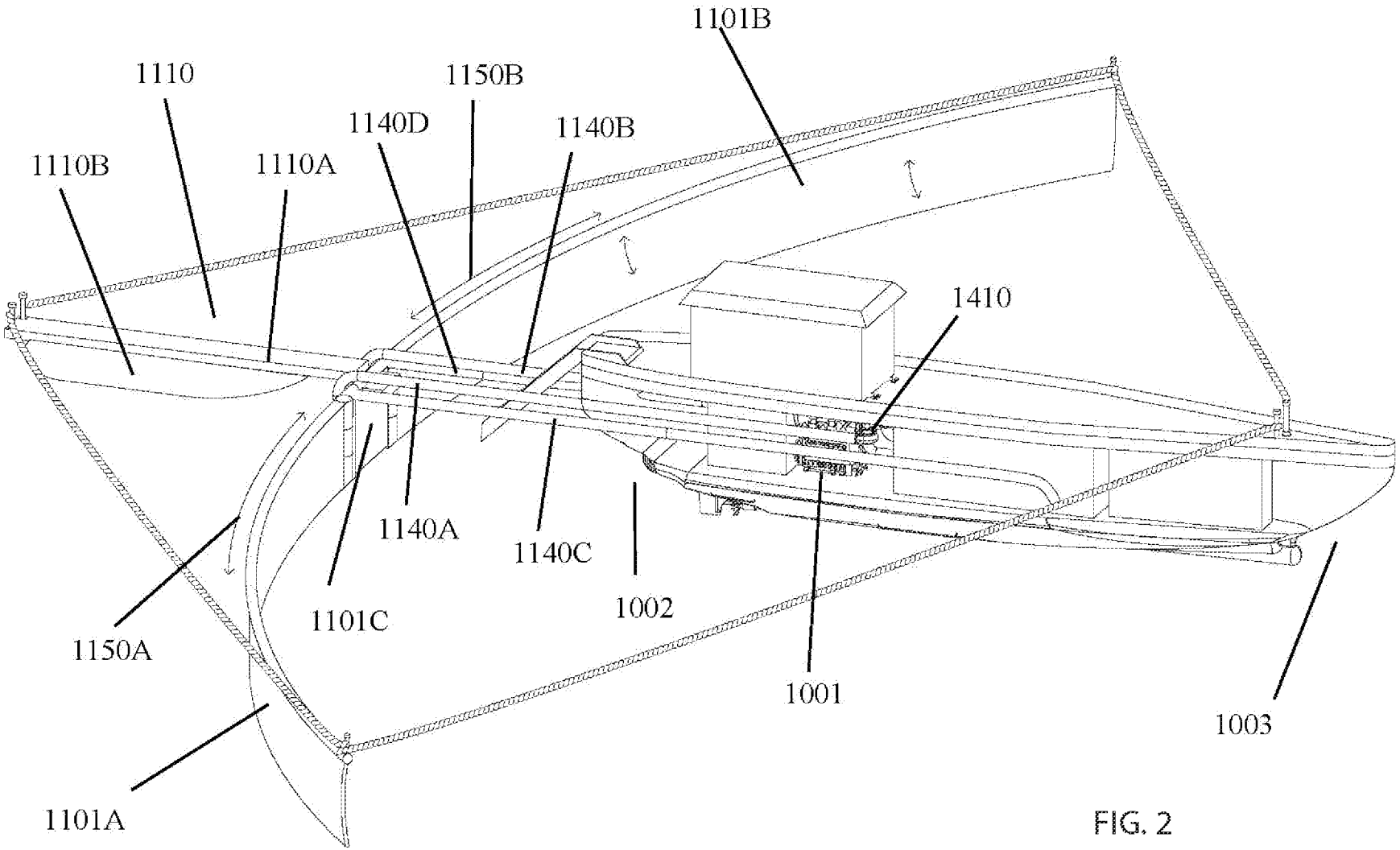
FIG. 2 provides a perspective view of a vessel and debris-collection system, according to an embodiment of the present invention.
Figure 3:
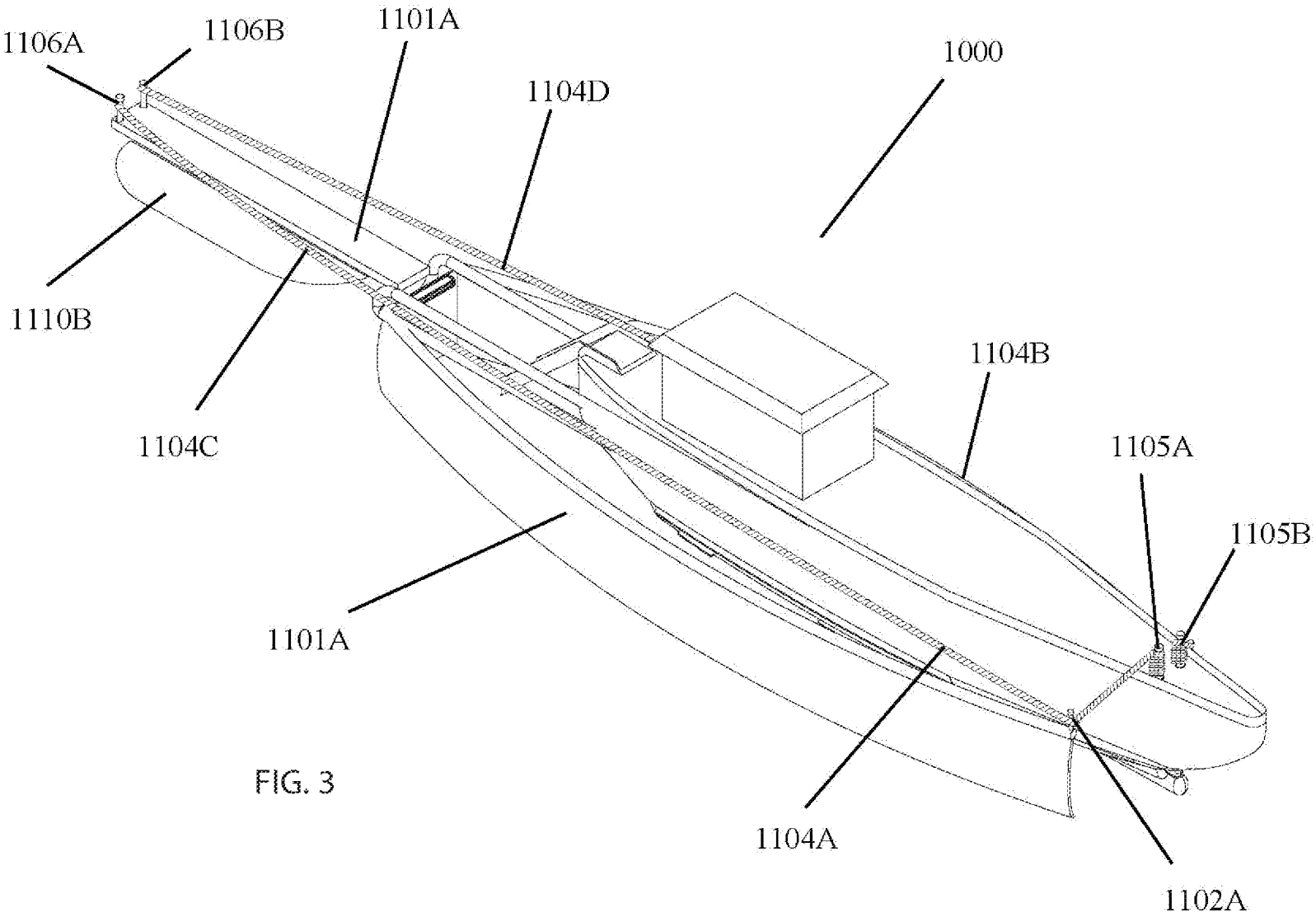
FIG. 3 provides a perspective view of a vessel and debris-collection system, according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

The present invention concerns a waterborne debris collection system integrated into a waterborne vessel for collecting surface and near surface debris in a body of water, such as a river, lake or ocean. The apparatus may include one or more solid collection booms that project laterally from a vessel and is partially submerged to act as a collection mechanism. The collection booms may comprise a solid screen operable to catch and collect debris at or near the surface of the water and facilitate the propulsion of the vessel by providing a barrier across which a differential water surface level may be created to drive the vessel forward. The apparatus may include a pumping system that draws water from the anterior side of the screen and for multiple purposes, including processing the collected water to remove plastics and other pollutant and debris material therefrom, and to transfer the water to the posterior side of the screen to create the differential water level for driving the vessel forward.

FIGS. 1-8 show an waterborne vessel 1000 that incorporates a debris collection system 1100 that is operable to collect waterborne debris. The debris collection system 1100 is mounted on the vessel 1000, which may be a conventional vessel outfitted with the features of the debris collection system 1100. In other embodiments, the vessel 1000 may be specially made for the debris collection function performed by the debris collection system 1100. The debris collection system 1100 may include two deployable booms 1101A and 1101B that each have a deployed condition in which the deployable booms 1101A and 1101B are bilaterally extended from the hull 1001 of the aquatic vessel 1000 and are operable to collect objects floating on or suspended near a surface of water.

Each of the deployable starboard collection boom 1101A and portside collection boom 1101B is positioned and shaped such that it collects plastic debris and other pollutants at or near the surface of water within its length and funnels the debris and pollutants toward a central aspect of the boom near the stern 1002 of the aquatic craft 1000. The aquatic craft 1000 is operable to move along the surface of the water with the starboard collection boom 1101A and portside collection boom 1101B partially submerged allowing them to collect debris and floating material from the surface of the body of water and material floating near the surface. The starboard collection boom 1101A may have a curvature 1150A and portside collection boom 1101B may have a curvature 1150B with a forward concave face and/or may be obliquely angled toward the bow 1003 of the vessel 1000 such that material collected by the starboard collection boom 1101A and portside collection boom 1101B is funneled toward the stern 1002 of the vessel 1000. The starboard collection boom 1101A and portside collection boom 1101B may be symmetrically arranged in the deployed position, extending from the starboard side and port side of the vessel 1000, respectively. In some embodiments, the starboard collection boom 1101A and portside collection boom 1101B may be constructed to have buoyancy to reduce stress on the connection between the booms and the vessel 1000. For example, each of the starboard collection boom 1101A and portside collection boom 1101B may have a watertight surface and enlarged inferior submerged aspect that displaces sufficient water to provide buoyancy to each of the booms. In other embodiments, each of the starboard collection boom 1101A and portside collection boom 1101B may have one or more buoys (e.g., metallic buoys) having a conical, circular, or cylindrical geometry to provide at the upper portion of the boom at the waterline, which may provide buoyancy to the starboard collection boom 1101A and portside collection boom 1101B and reduce stress on the vessel 1000.

The starboard collection boom 1101A and portside collection boom 1101B may be deployed by a deployment system that includes tethers 1104A, 1104B, 1104C, and 1104D positioned between bow 1003 of the vessel 1000 and an aft extension frame 1110 extending from the stern 1002 of the vessel 1000 to provide an anchoring point for the tethers 1104C and 1104D. The deployment system may include one or more forward spool mechanisms 1105A and 1105B at or near each side of the bow 1003 of the vessel 1000 and one or more aft spool mechanisms 1106A and 1106B at the aft extension frame 1110. Each spool mechanism may be in mechanical communication with a tether such that it may be able to draw the tether in or let the tether out to facilitate the deployment and stowing of the starboard collection boom 1101A or portside collection boom 1101B. The tethers may be anchored at an opposite end at or near a distal end of one of the deployable collection booms. The tether may be routed through boom spools or fixedly connected to an anchor or other structure operable to engage with the tethers at or near the distal ends of each collection boom. For example, tethers 1104A and 1104C may be fixedly connected or otherwise mechanically connected to anchor point 1102A, and the tethers 1104B and 1104D may be fixedly connected or otherwise mechanically connected to anchor point 1102B. In some examples, the anchor points 1102A and 1102B may be large rod-like structure having a diameter in a range of about 5 inches to about 15 inches and may be comprised of rigid material, such as a steel, iron, or other rigid materials. In some examples the anchor points may have latching or hooking structures protruding therefrom for attaching the tethers to the anchor points.

The starboard collection boom 1101A and portside collection boom 1101B may be deployed by the rotation of the of the paired forward and aft spool mechanisms such that the tethers are pulled toward to the aft spool mechanisms 1106A and 1106B, thereby pulling the anchor points 1102A and 1102B toward the aft spool mechanisms 1106A and 1106B, respectively, thereby pulling the starboard collection boom 1101A and portside collection boom 1101B toward the rear of the vessel 1000. The starboard collection boom 1101A and portside collection boom 1101B may pivot on large pivoting joints 1103A and 1103B positioned near the stern 1002 of the vessel 1000 to allow the starboard boom 1101A and portside boom 1101B to pivot outward away from the hull 1001 of the vessel 1000 and deploy laterally. The starboard collection boom 1101A and portside collection boom 1101B may be connected via the pivoting joints 1103A and 1103B to a central collection screen 1101C that is positioned behind the stern 1002. The boom anchors 1102A and 1102B positioned on or within the starboard collection boom 1101A and portside collection boom 1101B, respectively, may be moveably connected to the tethers 1104A, 1104C and 1104B, 1104D running between forward and aft spool mechanisms, such that as the tethers are pulled toward the aft spool mechanisms 1106A and 1106B. The spool mechanisms may be winches, such as electromechanical winches that are in electrical communication with a controller 1500, discussed below. In some embodiments, the anchors 1102A and 1102B may be spools that are stationary and unable to rotate, such that tension applied to the tethers by the rotation of the aft spool mechanisms 1106A and 1106B pulls the boom anchors 1102A and 1102B toward the aft spool mechanisms and applies sufficient tension to pivot and deploy the starboard collection boom 1101A and portside collection boom 1101B. As the starboard collection boom 1101A and portside collection boom 1101B are deployed the forward spool mechanisms 1105A and 1105B may rotate to let the tethers 1104A and 1104B out to prevent the application of tension to the tethers that opposes the tension applied by the aft spool mechanisms 1106A and 1106B to tethers 1104C and 1104D. The opposite stowing operation may be applied to draw the starboard collection boom 1101A and portside collection boom 1101B inward toward the hull 1001.

The collection booms 1101A and 1101B may be connected to an extended frame structure 1110 that extends posteriorly from the stern 1002 of the vessel 1000, and may be in alignment with the length (keel) of the vessel 1000. The extended frame 1110 may include a rigid metal frame structure, such as metal beams or pipes 1140A, 1140B that extend horizontally or substantially horizontally from the stern 1002 of the vessel 1000 to a pre-determined posterior distance from the stern 1002. The extended frame 1110 may also include a platform portion 1110A extending posterior from the collection screen 1101C, and a buoyant portion 1110B positioned on a bottom side of the extended frame 1110. The aft spooling mechanisms 1106A and 1106B may be positioned at or near the posterior end of the platform portion 1110A of the extended frame structure 1110. The flotation mechanism 1110B to aid in supporting the weight of the extended frame 1110. For example, the extended frame 1110 may include pontoons and/or other flotation structures. The central screen 1101C may be mechanically connected to the metal frame structure including metal beams or pipes 1140A, 1140B of extended frame structure 1110, providing an anchor point to the vessel 1000 for the starboard collection boom 1101A and the portside collection boom 1101B. The starboard collection boom 1101A and portside collection boom 1101B may be connected to the central screen 1101C by pivoting joints 1103A and 1103B, respectively, that allow the tethers and forward and aft spooling mechanisms to pivot the starboard collection boom 1101A and portside collection boom 1101B between stowed and deployed positions.

The process of deploying the starboard boom 1101A and portside boom 1101B may include unlocking a transmission system (unlocking a spool or reel on which the tether is wound) at the forward spooling mechanisms 1105A and 1105B to allow for a controlled release of the tethers 1104A and 1104B therefrom. The force of the fluid acting on the anterior surfaces of the starboard boom 1101A and portside boom 1101B may assist in deploying the booms to the open position. In some embodiments, the aft spool mechanisms 1106A and 1006B may each be in mechanical connection with one or more motors that may be in electrical communication with a tension sensor (e.g., strain gage) that is operable to communicate the cable tension to a controller 1500 and determine the specific torque necessary for the cable to draw the starboard collection boom 1101A and portside collection boom 1101B into the deployed position. Once the aft spool mechanisms have drawn the starboard collection boom 1101A and portside collection boom 1101B the deployed position, a locking mechanism (e.g., hook and pawl lock) may lock the spool mechanism in place and maintain optimal tension on the tethers to maintain the starboard collection boom 1101A and portside collection boom 1101B in the deployed position.

The starboard boom 1101A and portside boom 1101B may be retracted to the closed position proximal to the hull 1001. In this operation, the aft spool mechanisms 1106A and 1106B may be unlocked, and a transmission system (unlocking a spool or reel on which the tether is wound) at the forward spool mechanisms 1105A and 1105B may be engaged to allow a motor to which the forward spool mechanisms 1105A and 1105B are mechanically connected to spin the forward spool mechanisms to reel in the tethers 1104A and 1104B. The tensions in the aft tethers 1104C and 1104D are reduced and the forward cable tension is increased to pull the starboard collection boom 1101A and portside collection boom 1101B into the stowed position. Once the starboard collection boom 1101A and portside collection boom 1101B have reached the stowed position proximal to the hull 1101, the tension on the aft and forward tethers may be fixed with the spool mechanisms 1105A, 1105B, 1106A, and 1106B locked in place, e.g., with a hook and pawl or braking system. Forward tethers 1104A and 1104B may be routed through a pulley system for directing the tethers to the boom anchors 1102A and 1102B. The pulley system may prevent fray and surface fatigue on the tethers. An accelerometer in electronic communication with a controller 1500 may be placed at a position at or near the upper surface of each of the starboard boom 1101A and portside boom 1101B to communicate data to the controller. The accelerometer data may allow the controller 1500 to control both the forward and aft motors to release or hold a specific amount of cable line such that the starboard boom 1101A and portside boom 1101B do not translate abrupt or jerky motion to the vessel 1000. The controller 1500 may adjust the motors of the forward and aft spooling mechanism pairs 1105A/1106A and 1105B/1106B to adjust the speed at which the tethers are reeled or unreeled based on accelerometer data and controller calculations. The starboard boom 1101A and portside boom 1101B may also be utilized to turn the vessel 1000 by independent retracting or deploying the starboard boom 1101A and portside boom 1101B, e.g., to create differential drag on each side of the vessel 1000. The controller 1500 may be operable to activate and operate the motors connected to the aft and forward tethers may be fixed with the spool mechanisms 1105A, 1105B, 1106A, and 1106B on each side of the vessel 1000.

Figure 4:
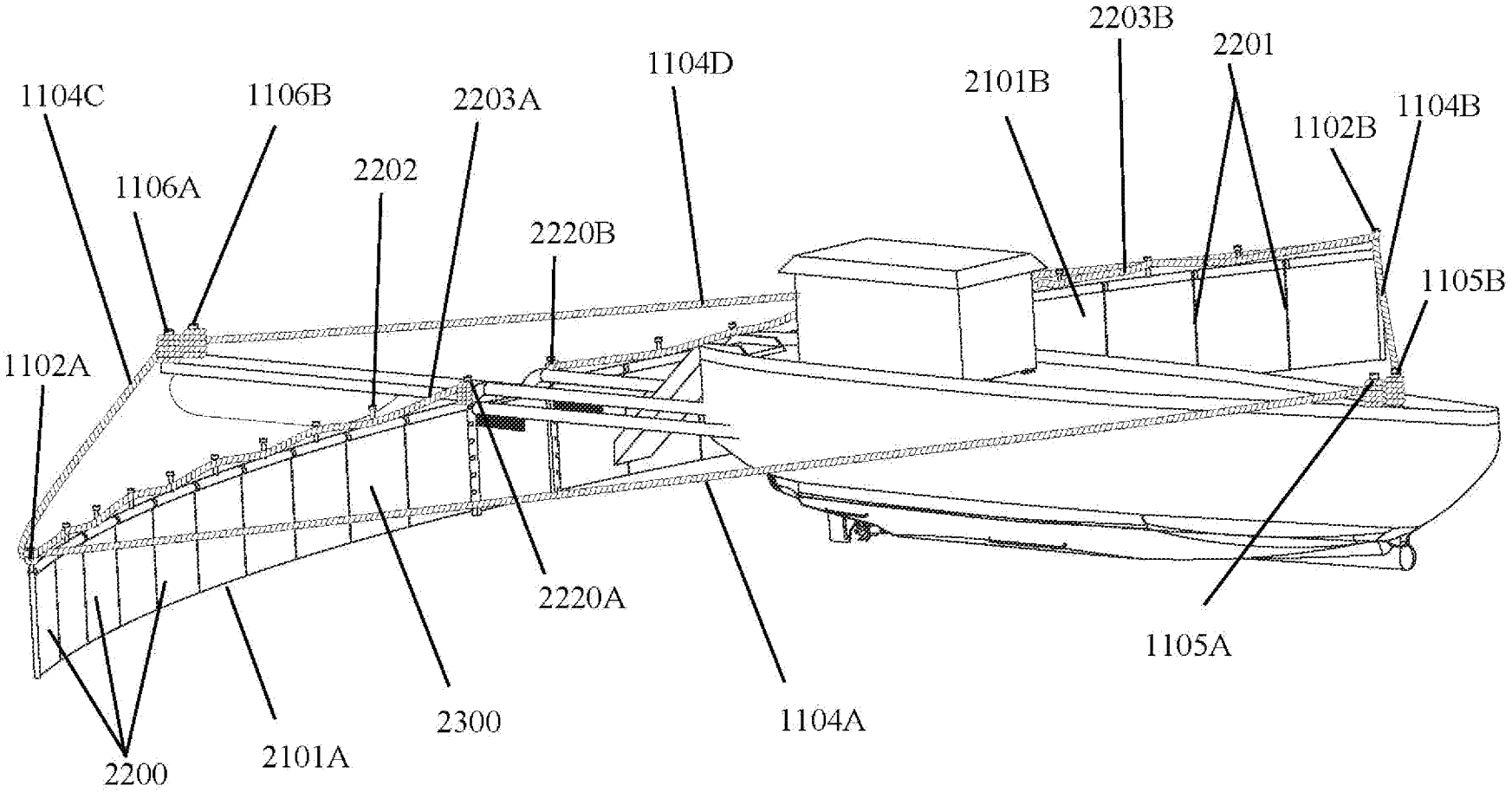
FIG. 4 provides a perspective view of a vessel and debris-collection system, according to an embodiment of the present invention.
Figure 5:
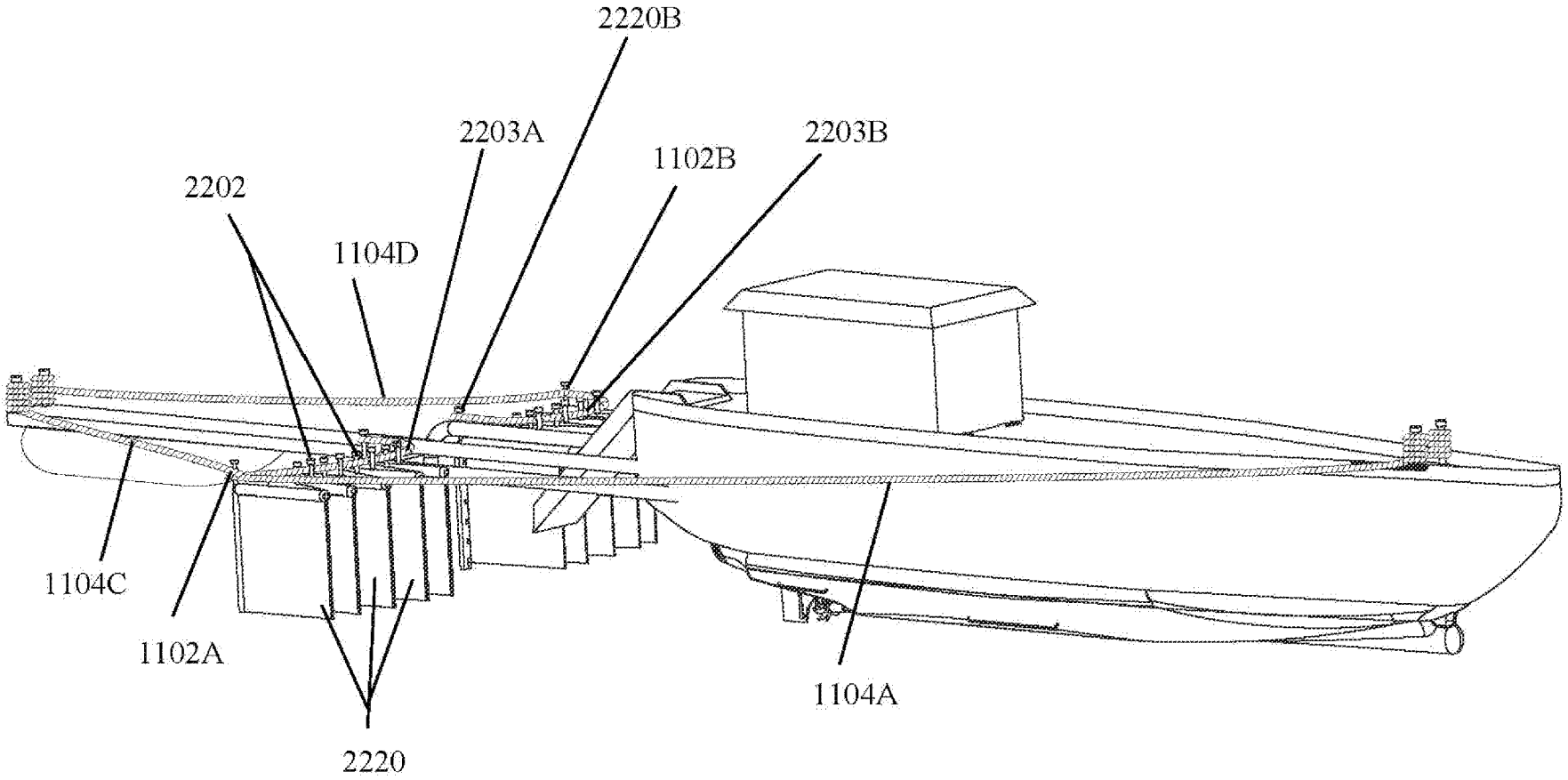
FIG. 5 provides a perspective view of a vessel and debris-collection system, according to an embodiment of the present invention.
Figure 6:
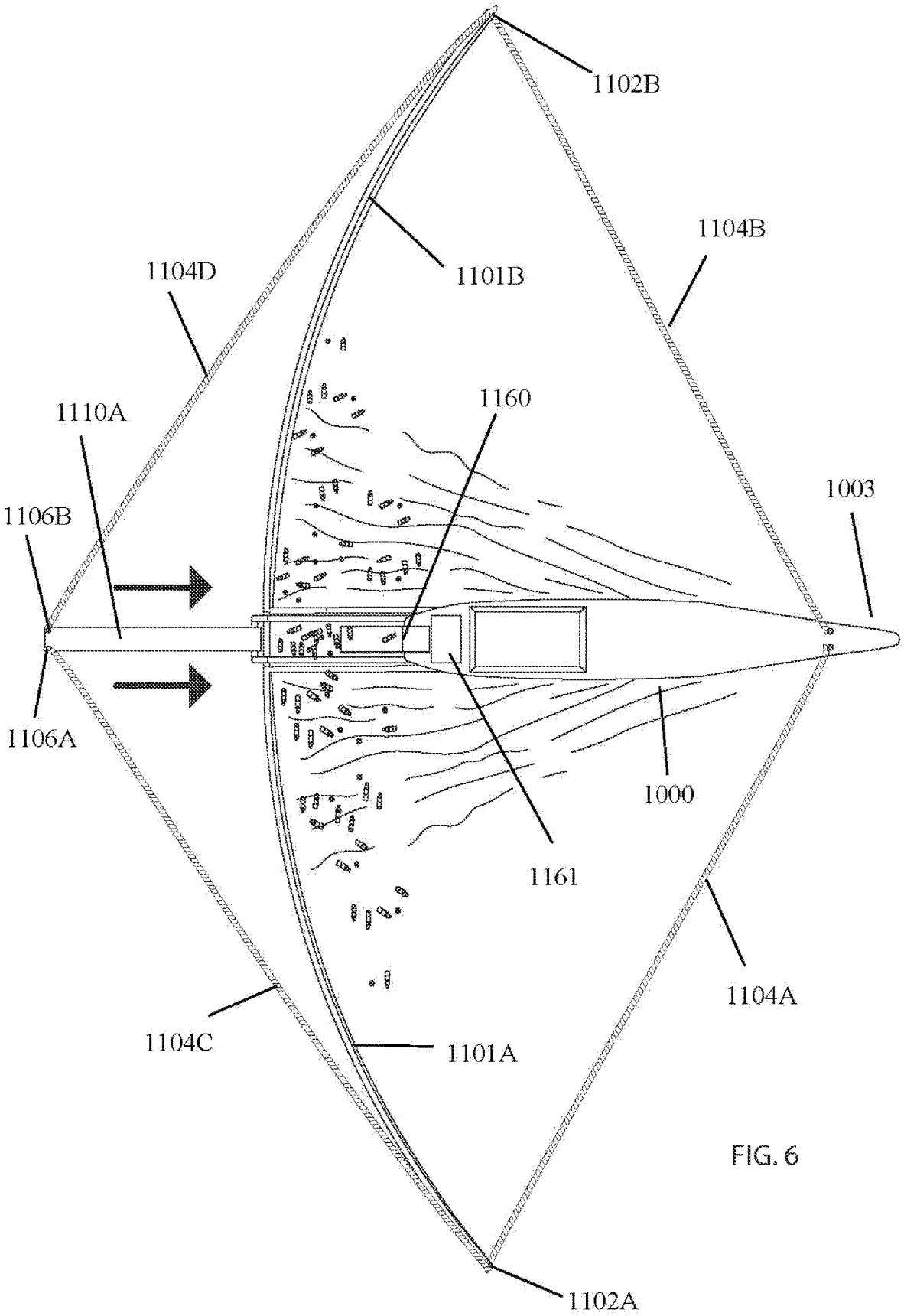
FIG. 6 provides an overhead view of a vessel and debris-collection system in use, according to an embodiment of the present invention.

In some embodiments, the starboard boom and portside boom may be comprised of a plurality of collapsible boom sections with pivoting connections between the boom sections. FIGS. 4-5 shows an embodiment having starboard boom 2101A and portside boom 2101B that includes a plurality of collapsible sections 2200. Pivoting connections 2201 may provide the connections between the collapsible sections 2200. The pivoting connections 2201 may be offset to a posterior end (outside) and an inner end (surface collecting and directing plastic) in an alternating fashion to allow the collection surface 2300 to collectively extend together and form a uniform collection surface 2300. The opposing ends of the pivoting connections 2201 may have lip and groove mating surfaces to facilitate joining the ends of each section 2200 of the starboard boom 2101A and portside boom 2101B together. Each of the boom sections 2200 may have a rotatable member 2202 (e.g., an idler, pulley, or other rotatable structure) that receives a boom tether 2203A or 2203B that is used to retract the collapsible sections 2200 from a deployed condition as shown in FIG. 5. The frame 1110 may have a starboard spooling mechanism 2220A (e.g., a winch, or other spooling device) and a portside spooling mechanism 2220B (e.g., a winch, or other spooling device) that are each operable to deploy and retract the boom tethers 2203A and 2203B, respectively. In such embodiments, the closed position may configure the plurality of boom sections 2200 into a collapsed, scissor linkage configuration. The boom surface 2300 may be retracted to the closed position by the starboard spooling mechanism 2220A and the portside spooling mechanism 2220B reeling in the boom tethers 2203A and 2203B. Deployment of the starboard spooling mechanism 2220A and the portside spooling mechanism 2220B from the closed position includes the steps of releasing the starboard spooling mechanisms 2220A and a portside spooling mechanisms 2220B from a locked condition and allow the force of the water on the screen and/or the action of the forward and aft spooling mechanism pairs 1105A/1106A and 1105B/1106B drawing the tethers 1104A, 1104B, 1104C, and 1104D in to facilitate the movement the various sections to an open position as the boom sections are extended to the open position both the aft and forward tethers are extended to allow the boom sections 2200 to join in an extended fashion. An additional watercraft may be used to assist in the deployment of the boom sections to form the collection booms 2101A and 2101B, such as a tugboat or other motor-driven watercraft. A tow line may be attached to the distal boom section of each collection boom and the additional watercraft may pull the distal boom section in a lateral or substantially lateral direction away from the hull of the vessel 1000 to assist in deployment.

The forward and aft spooling mechanism pairs 1105A/1106A and 1105B/1106B may be actuated by a motor in mechanical communication with a rotatable structure (e.g., an axel, sprocket, etc.) connected to or integrally formed in each spooling mechanism. The motor may be connected to the rotatable structure by a gearing assembly, chain, direct axle connection, or other mechanical connection such that the rotation of the motor drive shaft translates to the rotatable structure of the spooling mechanism. Each aft spooling mechanism 1106A, 1106B and forward spooling mechanism 1105A, 1105B may have its own motor or may be coupled by a transmission structure (e.g., gears, drive chains, etc.) to a shared motor. For example, the aft spooling mechanisms 1106A and 1106B may share a motor, and the forward spooling mechanisms 1105A and 1105B may share a motor. The one or more motors that are mechanically connected to the forward and aft spools may be controlled by the controller 1500 which may be in electronic communication with the one or more motors. The controller 1500 may measure the load on the booms 1101A and 1101B and collecting the surfaces 1300A and 1300B and display the loading measurements to a human operator on a graphical user interface. The controller 1500 may be in electronic communication with a torque sensor (e.g., a static or dynamic torque sensor) mounted monitor the torque on the motor and compare the torque to the tension of the tether tension sensor, and may adjust the one or more motors mechanically connected to the aft spooling mechanisms 1106A and 1106B and the forward spooling mechanisms 1105A and 1105B to provide a load equilibrium on the collection booms 1101A and 1101B. In some embodiments, the controller 1500 may be operable to autonomously determine necessary motor torque adjustments to provide stability and equalization of the tension on each of the tethers 1104A, 1104B, 1104C, and 1104D while maintaining boom loading in equilibrium. A central gyroscope may be positioned at the vessel's center mass, and the data may be processed by the controller 1500, and boom tether tension may be adjusted to provide vessel 1000 stability in rough water.

The collection booms 1101A and 1101B and the vessel 1000 may be of substantial size, with the vessel 1000 being a container ship or of similar size, and the collection booms 1101A and 1101B having a length substantially equal to the length of the vessel 1000 (e.g., about 500 feet to about 1000 feet). In some embodiments, the collection booms 1101A and 1101B may have a length that is equal to a substantial portion of the length of the vessel 1000 (e.g., about 200 feet to about 1000 feet). The height dimension of the collection booms 1101A and 1101B may be in a range of about 20 feet to about 80 feet, where the majority of the height dimension is submerged to collect materials that are suspended at shallow depths in the water column. The booms 1101A and 1101B and screen 1101C may also include a continuous collection surface (face) free or substantially free from gaps or perforations, such that fine debris are collected and retained by the collection booms 1101A and 1101B and screen 1101C. The collection booms 1101A and 1101B and screen 1101C may thus be of substantial size and mass, and must therefore be made of strong, robust materials. The collection booms 1101A and 1101B and screen 1101C may be comprised of rigid materials having some limited flexibility, as discussed herein.

The deployable collection booms 1101A and 1101B may have one or more curvatures. They may include a curvature along their lengths that bows the boom toward the bow 1003 of the vessel 1000 when the booms 1101A and 1101B are deployed, having a concave curvature facing in a forward manner. The boom 1101A may have a lengthwise curvature 1150A and boom 1101B may have a lengthwise curvature 1150B. The lengthwise curvatures may have the effect of pushing collected debris and material toward the stern of the ship where it may be collected. The booms 1101A and 1101B may also have a vertical curvature along their collection surfaces that results in a concave, forward oriented face that tends to push subsurface material upward toward the surface of the water. For example, the upper portion of the face may have a longer radius of curvature than the lower portion of the face. The boom 1101A may have a vertical curvature 1160A and boom 1101B may have a vertical curvature 1160B. The material pushed toward the surface of the water may then be pushed toward the stern of the ship by the lengthwise curvatures 1150A and 1150B.

Figure 8:
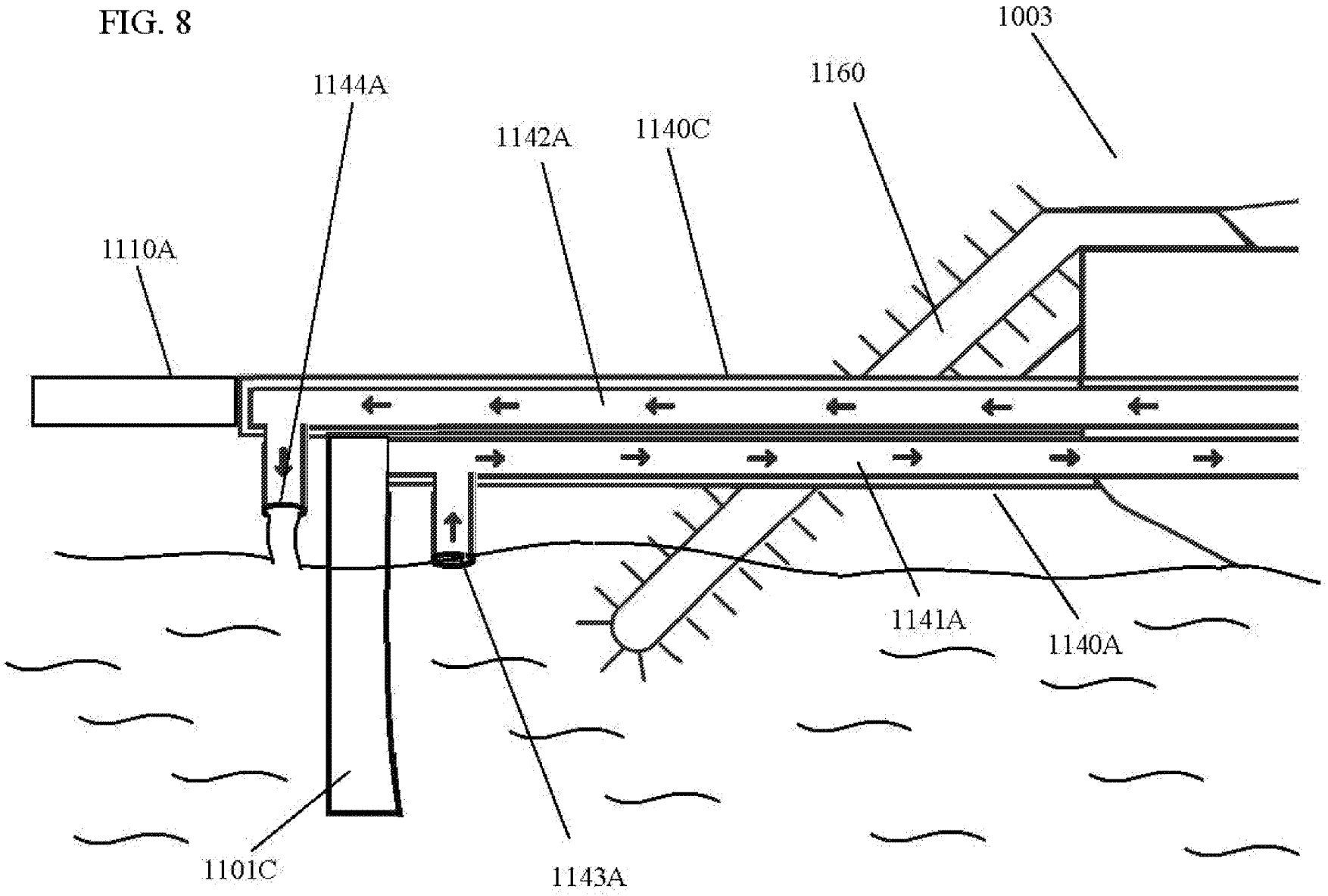
FIG. 8 provides a close-up view of the stern of the vessel and the extension frame of the debris-collection system, according to an embodiment of the present invention.

The deployable collection booms 1101A and 1101B may be connected to and supported by the extension frame 1110. The extension frame may include a posterior extension 1110A that extends posteriorly to the central screen 1101C and horizontal beams 1140A and 1140B on the starboard side and horizontal beams 1140C and 1140D on the port side that run between the stern 1002 and the central screen 1101C. The posterior extension 1110A may have one or more flotation devices 1110B (e.g., a pontoon) to lend mechanical support to the extension frame 1110 and reduce shearing stress on the extension frame 1110 and loading on the vessel 1000. The collection pipes may be mounted on or otherwise connected to the horizontal beams 1140A, 1140B, 1104C, and 1104D. As shown in FIG. 8, collection pipe 1141A may be mounted to horizontal beam 1140B and run along the horizontal beam 1140B to the central screen 1101C and to an intake port 1107 that has a submerged or partially submerged opening on the forward side of the central screen 1101C. The collection system 1100 may include a second collection pipe 1141B on the port side of the vessel 1000 that may be mounted to horizontal beam 1140D and run along the horizontal beam 1140D to the central screen 1101C and to an intake port 1107.

The collection system 1100 of the present invention may include multiple collection mechanisms. A liquid collection mechanism may be incorporated into and/or form part of the extension frame 1110. Water and debris up to a pre-determined size limit may be drawn from the area of the stern 1002 by the intake ports 1107 and 1143A and 1143B on the distal ends of intake pipes 1141A and 1141B—See FIG. 8. In some embodiments, the intake port 1107 may be fitted with a coarse filter have a perforation size in a range of about 1 $cm^2$ to about 10 $in^2$ (e.g., about 1 $in^2$ to about 4 $in^2$, or any value or range of values therein). The surface water and debris collected by the intake port 1107 may be drawn in by a fluid pump 1410 in fluid communication with the collection pipes 1141A and 1141B. The water and debris pumped through the collection pipes 1141A and 1141B may be routed to a filtering system 1175 operable to filter and collect the debris and material from the collected water. The debris and material are then transferred to a processing unit 1170 to be converted into usable fuel through a pyrolysis process, or other material conversion process. The processing unit 1170 may include a cleaning bath, densifier, and/or other systems for preparing the collected debris for pyrolysis. The water from which the debris and particulate waste material has been filtered may be returned to the rear of the vessel 1000 on the posterior side of the central screen 1101C for use in propulsion of the vessel 1001, as discussed in further detail below.

The debris collection system 1100 may also include at least one coarse debris collector 1160 positioned at or near the stern 1002 of the vessel 1000 to collect large objects and material in the water (e.g., fishing nets, large plastic objects such as bottles, packaging, etc., large pieces of Styrofoam, etc.). The coarse debris collector 1160 may include a partially submerged conveyor operable to collect coarse objects at or near the surface of the water at the stern 1002 of the vessel 1000. The conveyor may include a cycling belt that includes protrusions 1160A that aid in collecting coarse materials. The collected large debris and materials may be deposited through a collection port 1161 and transferred into a grinding station 1165 to be reduced to a size in a predetermined range: a range of about 0.25 $cm^2$ to about 1 $cm^2$. The materials recyclable for fuel ("pyrolyzable materials", e.g., Polypropylene, Polystyrene, Polyvinyl Chloride, Polymethylmethacrylate, etc.) may be segregated from the rest and ground separately from the remaining material. The processed output material of the grinding station 1165 that may be deposited on a conveyor 1162 for delivery to a processing system 1170.

In some embodiments, the coarse materials may be sorted prior to grinding into different batches of pyrolyzable material and non-pyrolyzable material. For example, the vessel 1000 may include a sorting system that uses optical analysis to identify material properties in the collected coarse materials using a near infrared (NIR) scanner to identify the pyrolyzable material and non-pyrolyzable material. The system may also include automated sorting techniques such as using selective gate that applies high pressure air blasts to the pyrolyzable low-density materials in order to remove them from the conveyor to separate them form the non-pyrolyzable material. The removed pyrolyzable material may be received in a catchment in proximity to the conveyor. An exemplary separation system that may be integrated into the vessel 1000 is a TOMRA™ auto-sorting system, as described in U.S. Pat. No. 8,259,298. In some embodiments, the materials may be sorted by human operators positioned at a conveyor between the collection port 1161 and the grinding station 1165. The two different batches may be put through separate grinding apparatus in the grinding station 1165. The grinding station 1165 may include one or more industrial grinding apparatus operable to grind a wide range of materials Grinder types may include granulators, hammermills, shear shredders, using abrasion with compression to pulverize materials, usually to produce granular products.

The ground pyrolyzable materials may be sent via conveyor 1162 to the processing system 1170. The non-pyrolyzable material may be collected in a waste storage area in the vessel 1000. The processing system 1170 may include a bath to which the ground pyrolyzable materials may be delivered. The bath may contain water or a washing solution and the pyrolyzable materials may be agitated in the bath in order to remove residues and unwanted surface contaminants thereon, such as oils, organic particulates or other debris. The pyrolyzable materials may then be removed from the bath and transferred to a densifier within the processing system 1170 that compresses materials and removes water or solution from the bath. The densifier may be an agglomerator or plastic granulator operable to refine the shredded materials into chunks or small granular for easy transportation into a pyrolysis chamber.

The water collected through the intake port 1107 and transported through collection pipes 1141A and 1141B may be transferred to a filtering system 1175 for removing microplastics and other particulates from the collected water. The filtering system may have a series of screen filters of different pore sizes, and the collected water may be passed through the filters in series from the largest pore size filter to the smallest. The filters may have a pore size in a range of about 5 $\mu m^2$ to about 1 $cm^2$. In some embodiments, the water passed through the screen filters may be further filtered by an additional process, such as reverse osmosis in order to remove additional microplastics and smaller particulates, such as nanoplastics. The filtered water may then be collected and passed to the pumping system 1410 via a return pipe 1142.

A pyrolysis system 1180 may convert the pyrolyzable materials into one or more fuels. The densified pyrolyzable material may be transferred to the pyrolysis chamber from the processing system 1170, and the chamber may then be sealed to form a pressure vessel. Once the pyrolyzable materials are delivered into the pyrolysis vessel 1180, the pyrolysis system 1180 may perform the steps of the application of a partial vacuum and heat to the vessel to boil and separate the materials into different hydrocarbon components, separation of the hydrocarbon components, and transferring the pyrolyzed material into a fractioning system 1180 for a separation process to recover hydrocarbon fuels. The vacuum applied to the pressure vessel may remove oxygen, nitrogen, and other air components from the pressure vessel, which would serve as contaminants to the pyrolysis process. The temperature in the pressure vessel may be increased to an operation range of about 300° C. to 900° C. The specific temperature of the pressure vessel may be varied depending on the temperature required to melt a particular combination of pyrolyzable materials present in the chamber. The controller 1500 may determine the ideal temperature and pressure settings for the combination of recyclable materials collected and prepared for the pyrolysis process. The pyrolysis process may utilize one or more catalysts, such as zeolite minerals (e.g., ZSM-5, zeolite, Y-zeolite, MCM-41 zeolite, and/or other zeolite catalysts), HZSM-5, mesoporous $SiO_2$—$Al_2O_3$, or other catalysts to facilitate the conversion of the pyrolyzable material to usable hydrocarbon fuels.

The pyrolyzable materials may be boiled in the chamber to form distinct components, which may include oil, gas, and black carbon slag. The reaction may be carried out for a period in a range of about 10 minutes to about 80 minutes, (e.g., about 30 minutes to about 45 minutes, or any value therein), which may be sufficient time to convert the plastic waste (organic polymers) into hydrocarbon monomers under the reaction conditions. Components of the pyrolyzed mixture may be separated for use as fuel. In some embodiments, the pressure vessel may be in communication with a fractioning unit 1185, which may be operable to separate both gaseous and liquid fractions of the hydrocarbon fuel produced by the pyrolysis system 1180. A nozzle may draw the gases to a condenser in the fractioning system 1185 through an oil and gas line. The condenser may cool the gases from the pressure vessel and route them to a fractioning unit 1185. The fractioning unit 1185 may utilize fractional distillation to separate the hydrocarbon fractions of the harvested pyrolysis output. The hydrocarbon fractions may then be stored and/or transferred via conduit systems 1186 to storage tanks 1187 (e.g., a diesel tank, a gasoline tank, etc.) for engine fuel. A portion of the hydrocarbon material produced by the fractional distillation process may include pyrolytic liquid oil, which may be used as a fuel without further refinement. It may be optimized by mixing with a refined fuel, such as diesel. Such mixtures can be used in the engine 1001 of the vessel 1000 (e.g., a diesel engine) or generators 1188 for providing electrical power for the fluid pumps 1410.

The water pumping system 1410 of the vessel 1000 functions in both the collection of the waterborne debris by drawing surface water through the collection pipes 1141A and 1141B at the stern 1002 and in the propulsion of the vessel 1000. The water may be drawn through the collection pipes 1141A and 1141B, through a filtering system 1175 and to the pyrolysis system 1180. The filtering system 1175 catches the plastic particulate matter collected by the intake port 1107 and removes it from the collected water. The particulate matter may be delivered to the pyrolysis system 1180 and the water may be piped back through a return pipe 1411 to the pumping system 1410 to the stern 1002 of the vessel 1001 and to the exterior of the vessel 1001 through return pipes 1142A and 1142B that extend beyond the collection booms 1101A and 1101B such that the return pipes 1142A and 1142B are operable to deliver the water to the aft (posterior) side of the central screen 1101C.

The return pipes 1142A and 1142B may have open ends 1144A and 1144B positioned to the aft of the collection booms 1101A and 1101B—See FIG. 8. The rate of water flow from the stern 1002 to the aft side of the central screen 1101C and collection booms 1101A and 1101B may be sufficient to create a height differential between the water on the aft side and the forward side of the collection booms 1101A and 1101B to cause the raised water to apply a force to the aft side of the collection booms 1101A and 1101B. The gravity acting on the raised surface level of the water generates a force applied to the aft side of the central screen 1101C and collection booms 1101A and 1101B, pushes them in a forward direction, and thereby propels the vessel 1000 forward. The rate of water flow may be in the range of about 1000 GPM to 1500 GPM (e.g., about 60,000 GPH to 90,000 GPH, or any value therein).

The pump system 1410 may be a high flow rate pump operable to move such high volumes of water, such as large centrifugal pump having an impeller with a radius in the range of about 8 inches to about 24 inches operable to spin at a rate in a range of about 1000 rpm to about 4000 rpm, a suction flange having a diameter in a range of about 12 inches to about 24 inches, and a discharge flange having a diameter in a range of about 8 inches to about 15 inches. The motor may be electrical and powered by an onboard generator powered by hydrocarbon gases (e.g., butane, propane, and/or other hydrocarbon gases) and/or liquid fuels (e.g., diesel, gasoline, pyrolytic liquid oil, etc.) generated through the pyrolysis process.

Figure 7:
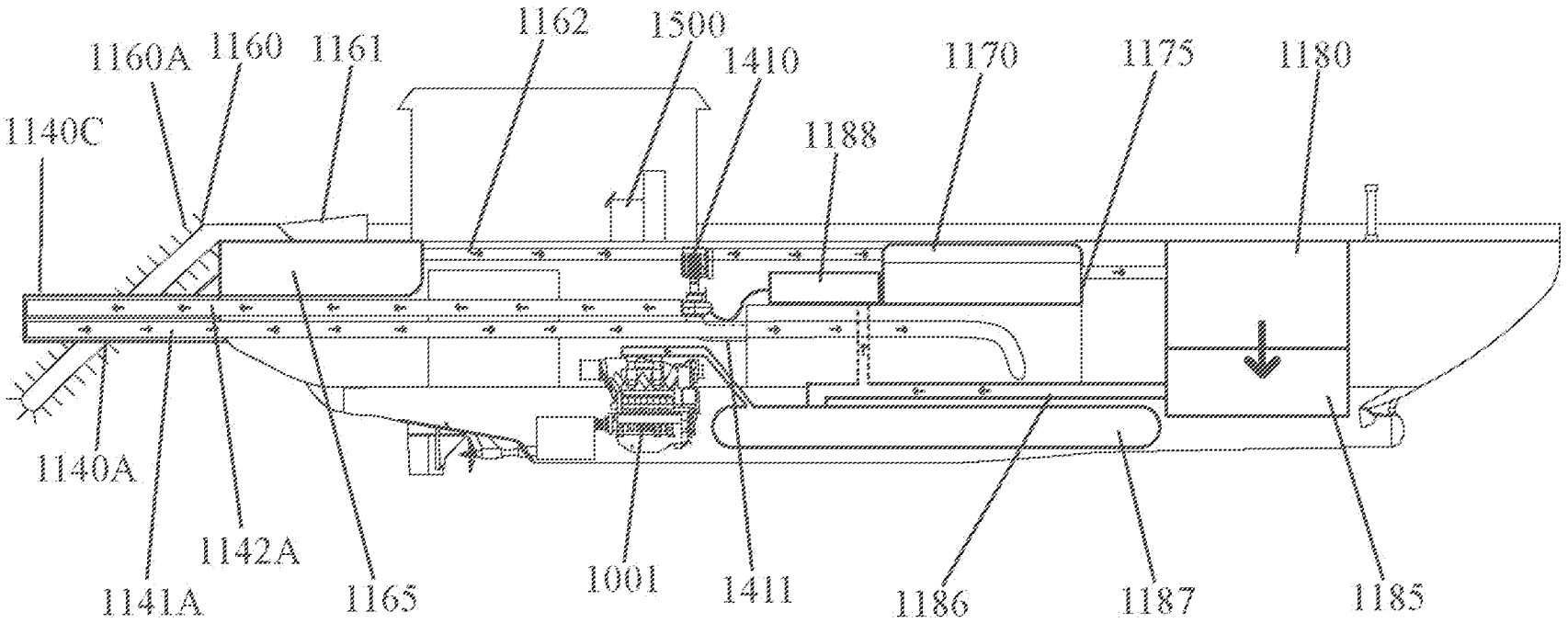
FIG. 7 provides an cross-sectional view of a vessel and debris-collection system, according to an embodiment of the present invention.

The propulsion created by the water displacement is sufficient on its own to drive the vessel 1000 forward during a debris collection operation. The collection operation is shown in FIG. 7, which shows the direction of travel with directional arrows. The water transfer to the posterior side of the central screen 1101C and collection booms 1101A and 1101B may provide a velocity in a range of about 0.5 knots to about 3 knots. This relatively slow pace is adequate and preferred for the collection process as time is needed to funnel debris caught by the lateral areas of the collection booms 1101A and 1101B toward the stern 1002 of the vessel 1000 where they can be collected by the intake port 1107 or the collection conveyor 1160. During the collection operation, the engine 1001 of the vessel 1000 can be shutdown, and fuel for the engine 1001 F1140 can be saved. Additionally, the pyrolysis system 1180 can produce additional fuel for the engine 1001 that can be added to the fuel supply for the engine. As a result, the vessel 1000 may sustain a debris collection operation for periods of time far longer than if the vessel 1000 needed to run its engine 1001 continuously and/or the vessel 1000 was not equipped with a pyrolysis system 1180 for generating hydrocarbon fuel from the collected polymeric waterborne debris.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A waterborne debris collection apparatus for use with an aquatic craft, comprising:

a) a plurality of deployable collection booms for collecting debris from a body of water each having a proximal end positioned at a pivoting joint and a distal end operable to be moveable between a stowed position proximal to a hull and an extended collection position away from the hull, wherein said plurality of collection booms form at least a part of a continuous debris collection structure positioned behind the aquatic craft and that extends laterally beyond a starboard side of the aquatic craft and laterally beyond a port side of the aquatic craft;

b) a boom deployment system which includes a tether system to which said at least one boom is mechanically connected, a rearward extending frame member, and a connection point at or near a bow of the aquatic craft; and c) a pumping system operable to collect debris-laden water from an area anterior to the at least one deployable collection boom and to dispose of the collected water on a posterior side of the at least one deployable collection boom.

2. The apparatus of claim 1, wherein said plurality of deployable collection booms include two deployable booms, each being pivotally connected to the aquatic craft at a position spaced a stern, and the two deployable booms are bilaterally deployable from the aquatic craft.

3. The apparatus of claim 2, wherein said two deployable booms are positioned bilaterally with respect to said aquatic vessel and both have a stowed position in which said two deployable booms are drawn in to proximity with the hull of said aquatic craft, and a deployed position in which the two booms are deployed bilaterally away from the hull of the aquatic craft.

4. The apparatus of claim 3, wherein said tether system includes at least one forward spooling mechanism and at least one aft spooling mechanism for each of said deployable booms, said forward spool operable to gather and release a forward tether that is mechanically connected at or near a distal end of said deployable boom, and said aft spool being mounted on said rearward extending frame member and being operable to gather and release an after tether that is mechanically connected at or near said distal end of said deployable boom.

5. The apparatus of claim 1, further comprising at least one debris collection conduit operable to collection said waterborne debris at or near a surface of the body of water.

6. The apparatus of claim 1, further comprising a collection conveyor operable to collect coarse waterborne solid debris at or near a surface of the body of water.

7. The apparatus of claim 6, further comprising a sorting station for segregating said coarse waterborne debris, wherein pieces of said waterborne debris differ in material content and said sorting station segregates said pieces of said waterborne debris based on said material content.

8. The apparatus of claim 6, further comprising a pyrolysis system, and at least a portion of said coarse waterborne debris is delivered to said pyrolysis system and pyrolyzed by said pyrolysis system to generate hydrocarbon fuels.

9. An aquatic vessel comprising:

a) at least one deployable collection boom for collecting debris from a body of water having a proximal end positioned at a pivoting joint and a distal end operable to be moveably positioned proximal to a hull and at an extended collection position away from the hull, wherein said at least one deployable collection boom forms at least a part of a continuous debris collection structure positioned behind the aquatic craft and that extends laterally beyond the starboard side of the aquatic craft and laterally beyond the port side of the aquatic craft;

b) a debris collection system at least one debris collection conduit and a pump that is operable to collect debris-laden water from an area anterior to the at least one deployable collection boom;

c) at least one filter operable to remove solid debris from the debris-laden water to yield filtered water; and d) a conduit operable to expel said filtered water on the posterior side of the continuous debris collection structure, thereby propelling the aquatic craft forward.

10. The vessel of claim 9, wherein expelling said filtered water on the posterior side of the continuous debris collection structure creates a differential water level between the anterior and posterior sides of the deployable collection boom that results in a force applied to the posterior side of the deployable collection screen that propels the aquatic craft forward.

11. The vessel of claim 10, wherein said at least one deployable boom includes two deployable booms, each being pivotally connected to the aquatic craft at a position spaced from a stern, and the two deployable booms are bilaterally deployable from the aquatic craft.

12. The vessel of claim 11, wherein said two deployable booms are positioned bilaterally with respect to said aquatic vessel and have a stowed position in which said two deployable booms are drawn in to proximity with the hull of said aquatic craft, and a deployed position in which the two booms are deployed bilaterally away from the hull of the aquatic craft.

13. The vessel of claim 9, wherein said at least one debris collection conduit is operable to collect said waterborne debris at or near a surface of the body of water.

14. The vessel of claim 9, further comprising a collection conveyor operable to collect coarse waterborne debris at or near a surface of the body of water.

15. A waterborne debris harvester apparatus for use with an aquatic craft, comprising:

a) at least one collection boom for collecting debris from a body of water forming at least a part of a continuous collection screen posterior to a stern that spans from a starboard side of the aquatic craft to a port side of the aquatic craft; and b) a debris collection system operable to collect debris-laden water from an area anterior to the continuous collection screen and to dispose of the collected water on a posterior side of the at least one collection boom thereby propelling the aquatic craft forward.

16. The apparatus of claim 15, further comprising a pivoting joint that allows the at least one collection boom to be drawn in toward a hull to a stowed position, and a boom deployment system which includes a tether system to which said at least one boom is mechanically connected, a rearward extending frame member, and a connection point at or near the stern of the aquatic craft.

17. The apparatus of claim 16, wherein said at least one boom includes two deployable booms, each being pivotally connected at or near a central portion of said continuous collection screen, and the two deployable booms are bilaterally deployable from the aquatic craft.

18. The apparatus of claim 17, wherein said two deployable booms are positioned bilaterally with respect to said aquatic craft and have a stowed position in which said two deployable booms are drawn in to proximity with a hull of said aquatic craft, and a deployed position in which the two booms are deployed bilaterally, away from the hull of the aquatic craft.

19. The apparatus of claim 18, wherein said continuous collection screen collects waterborne debris and guides said debris toward a collection zone at or near the stern of the aquatic craft.

20. The apparatus of claim 15, further comprising a pyrolysis system, wherein at least a portion of said coarse waterborne debris is delivered to said pyrolysis system and pyrolyzed by said pyrolysis system to generate hydrocarbon fuels.

* * * * *